US008916790B1

(12) United States Patent
Ando

(10) Patent No.: US 8,916,790 B1
(45) Date of Patent: Dec. 23, 2014

(54) SWITCHGEAR

(71) Applicant: Kabushiki Kaisha Yaskawa Denki, Kitakyushu-shi (JP)

(72) Inventor: Norio Ando, Fukuoka (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 0 days.

(21) Appl. No.: 14/180,359

(22) Filed: Feb. 14, 2014

(30) Foreign Application Priority Data

Jul. 30, 2013 (JP) ..... 2013-157916

(51) Int. Cl.
*H01H 3/38* (2006.01)
*H01H 33/666* (2006.01)

(52) U.S. Cl.
CPC ..... *H01H 33/666* (2013.01)
USPC ..... 218/154; 218/120; 218/136; 218/143

(58) Field of Classification Search
USPC ..... 218/118–120, 136, 143
See application file for complete search history.

(56) References Cited

U.S. PATENT DOCUMENTS

| | | | | |
|---|---|---|---|---|
| 4,225,763 | A * | 9/1980 | Barkan | 218/120 |
| 4,788,390 | A * | 11/1988 | Crino | 218/143 |
| 4,952,759 | A | 8/1990 | Perret | |
| 5,597,992 | A * | 1/1997 | Walker | 218/121 |
| 5,808,258 | A * | 9/1998 | Luzzi | 218/136 |
| 6,020,567 | A | 2/2000 | Ishikawa et al. | |
| 6,156,989 | A * | 12/2000 | Miller et al. | 218/120 |
| 7,075,027 | B1 * | 7/2006 | Fogle et al. | 218/154 |
| 7,115,828 | B2 * | 10/2006 | McCord et al. | 200/400 |
| 7,663,457 | B2 * | 2/2010 | Szeifert et al. | 335/179 |

FOREIGN PATENT DOCUMENTS

| | | |
|---|---|---|
| EP | 1367616 | 12/2003 |
| JP | 01-265418 | 10/1989 |
| JP | 07-296687 | 11/1995 |
| JP | 11-072179 | 3/1999 |
| JP | 2004-071540 | 3/2004 |
| JP | 2004-342359 | 12/2004 |

OTHER PUBLICATIONS

Japanese Office Action for corresponding JP Application No. 2013-157916, Sep. 3, 2013.

* cited by examiner

*Primary Examiner* — Truc Nguyen
(74) *Attorney, Agent, or Firm* — Mori & Ward, LLP

(57) ABSTRACT

Disclosed is a switchgear including: a vacuum chamber; a fixed electrode having a fixed contact at an end thereof, the fixed contact being disposed within the vacuum chamber; a movable electrode having a movable contact at an end thereof, the movable contact being disposed within the vacuum chamber; a linkage assembly electrically connecting or disconnecting the movable electrode and the fixed electrode; an engaging coil spring; and a disengaging coil spring. The engaging coil spring and the disengaging coil spring are provided such that centers of the diametric directions thereof are substantially coaxial and at least a part of the engaging coil spring and a part of the disengaging coil spring overlap each other.

11 Claims, 4 Drawing Sheets

100
10
20
30
33
50
50d
S1
S2
52
53
54
55
40
Mg

SWITCHGEAR

CROSS-REFERENCE TO RELATED APPLICATION

This application is based upon and claims the benefit of priority from Japanese Patent Application No. 2013-157916, filed Jul. 30, 2013, the entire contents of which are incorporated herein by reference.

BACKGROUND

1. Field

An aspect of the present invention relates to a switchgear.

2. Related Background Art

A switchgear is a device for opening and closing a power circuit. The switchgear includes two contacts, and enables electrification when these are in contact with each other, whereas a state in which the power circuit is broken occurs when these are separated. When the switchgear changes from an electrically connected state to a disconnected state by separating the two contacts, arcs (sparks) tend to be generated between the contacts. Since arcs tend not to last in a vacuum, switches in which two contacts are housed in a vacuum chamber are known in the art (See Japanese Patent Laid-Open Publication No. 2004-342359, Japanese Patent Laid-Open Publication No. H07-296687, Japanese Patent Laid-Open Publication No. H11-72179, U.S. Pat. No. 4,952,759, and European Patent No. 1367616A1).

SUMMARY

A switchgear according to one aspect of the invention includes a vacuum chamber capable of maintaining an inside thereof in a decompressed state; a fixed electrode having a fixed contact at an end thereof, the fixed contact being disposed within the vacuum chamber; a movable electrode having a movable contact at an end thereof, the movable contact being disposed within the vacuum chamber and at a position facing the fixed contact; a linkage assembly configured to electrically connect or disconnect the movable electrode and the fixed electrode; an engaging coil spring configured to transfer a force to the movable electrode in a direction in which the movable contact engages with the fixed contact; a disengaging coil spring configured to transfer a force to the movable electrode in a direction in which the movable contact disengages from the fixed contact; and a spring-mounting member constituting a single whole, having an opening passing through the member in a moving direction of the movable electrode, installed between the movable electrode and the linkage assembly, and provided with the engaging coil spring and the disengaging coil spring, wherein the engaging coil spring and the disengaging coil spring are provided such that centers of the diametric directions of the engaging coil spring and the disengaging coil spring are substantially coaxial and at least a part of the engaging coil spring and a part of the disengaging coil spring overlap each other in the moving direction of the movable electrode.

DETAILED DESCRIPTION

Figure 1:
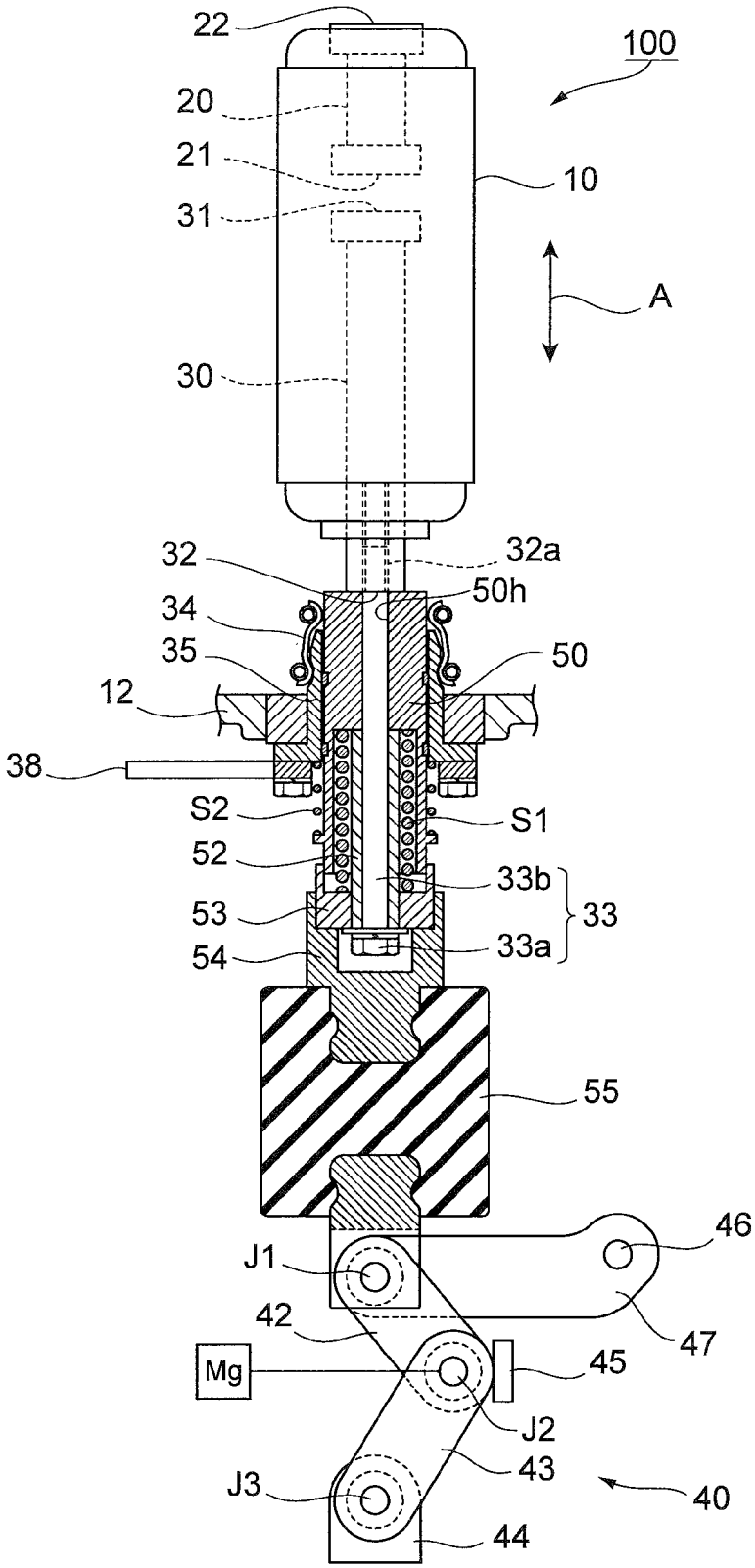
FIG. 1 is a sectional view schematically illustrating a switchgear according to an embodiment.

Hereinafter, a plurality of embodiments of the present invention will be described with reference to the accompanying drawings. In the description of the drawings, the same elements will be designated by the same reference numerals and a duplicate description thereof will be omitted. The drawings and the related technologies are provided in order to describe the embodiments of the present invention, and do not limit the scope of the present invention.

A switchgear 100 shown in FIG. 1 includes a vacuum chamber 10, a fixed electrode 20, a movable electrode 30, a linkage assembly 40 for driving the movable electrode 30, and two coil springs (engaging spring S1 and disengaging spring S2). The engaging spring S1 and the disengaging spring S2 are disposed such that at least a part of the engaging spring S1 and a part of the disengaging spring S2 overlap each other in the moving direction of the movable electrode 30 (in the direction of an arrow A shown in FIG. 1). In the following description, up and down indicate the direction of the arrow A shown in FIG. 1. A part constituted by the vacuum chamber 10, the fixed electrode 20, and the movable electrode 30 is also called a vacuum switch.

In the switchgear 100, the two coil springs S1 and S2 are disposed such that at least a part of the coil spring S1 and a part of the coil spring S2 overlap each other in the axial direction thereof (in the direction of the arrow A). Further, the coil springs S1 and S2 are disposed to be substantially coaxial. The switchgear 100 has excellent performance despite being a compact size.

The above-mentioned configuration enables the length of the switchgear 100 to be shortened in the direction of the arrow A. First, the short length switchgear is advantageously installed in an electric pole or under the ground. Although the length of the switchgear 100 may be changed according to the required performance or installation position of the switchgear 100, when the two coil springs S1 and S2 overlap each other over a length of about 40 mm to 50 mm, the length of the switchgear 100 may be shortened by the amount caused by overlapping the two coil springs S1 and S2 in the direction of the arrow A, as compared with a case where the two coil springs do not overlap each other. Further, as the length in the direction of the arrow A is shortened, the strength against a compressive force increases and bending caused by resilient forces of the two coil springs (especially, the engaging spring S1) can be suppressed. Thus, a pressing force between contacts may be set to have a sufficiently large value. As a result, for example, even when a strong repulsive force is generated between the electrodes 20 and 30 by a short circuit current, it is possible to sufficiently suppress the switchgear 50 from becoming electrically disconnected at an unintended time point. Hereinafter, the configuration of each component of the switchgear 100 will be described.

The vacuum chamber 10 is a chamber capable of maintaining the inside thereof in a decompressed state. The vacuum chamber 10 is supported by a frame 12 (only partially drawn) configured of an insulating material. The vacuum chamber 10 has an opening at an upper end, and is installed such that an end portion of the fixed electrode 20 is inserted into the opening. The vacuum chamber 10 also has an opening at a lower end, and is installed such that an end portion of the movable electrode 30 is inserted into the opening and the movable electrode 30 can be moved in the direction of the arrow A. The herein-mentioned "fixed electrode" refers to an electrode fixed to the vacuum chamber when the switchgear is used. For example, during a maintenance checkup, the fixed electrode 20 may be separated from the vacuum chamber 10 and the fixed location of the fixed electrode 20 may be adjusted.

The fixed electrode 20 has a fixed contact 21 at an end thereof, and the fixed contact 21 is disposed within the vacuum chamber 10. Another end 22 of the fixed electrode 20 is exposed to the upper surface of the vacuum chamber 10 and is configured to be connected to a terminal.

The movable electrode 30 has a movable contact 31 at an end thereof. The movable contact 31 is disposed within the vacuum chamber 10 and faces the fixed contact 21. The movable electrode 30 has a screw hole 32*a* formed at another end 32. The screw hole 32*a* may be mounted with an end of a bolt 33 which is configured of conductive material (for example, a metal). Accordingly, a spring-mounting member 50 which will be described below may be fixed between the end 32 of the movable electrode 30 and a head portion 33*a* of the bolt 33.

The movable electrode 30 is electrically connected to a terminal 38 fixed to the frame 12. That is, an electrically conducting path is formed between the movable electrode 30 and the terminal 38 by the parts configured of conductive material (the spring-mounting member 50, a spring type contact 34, and a collar 35). The spring type contact 34 electrically connects the spring-mounting member 50 and the collar 35. The collar 35 is fixed to the frame 12 together with the terminal 38 by bolts.

Figure 2:
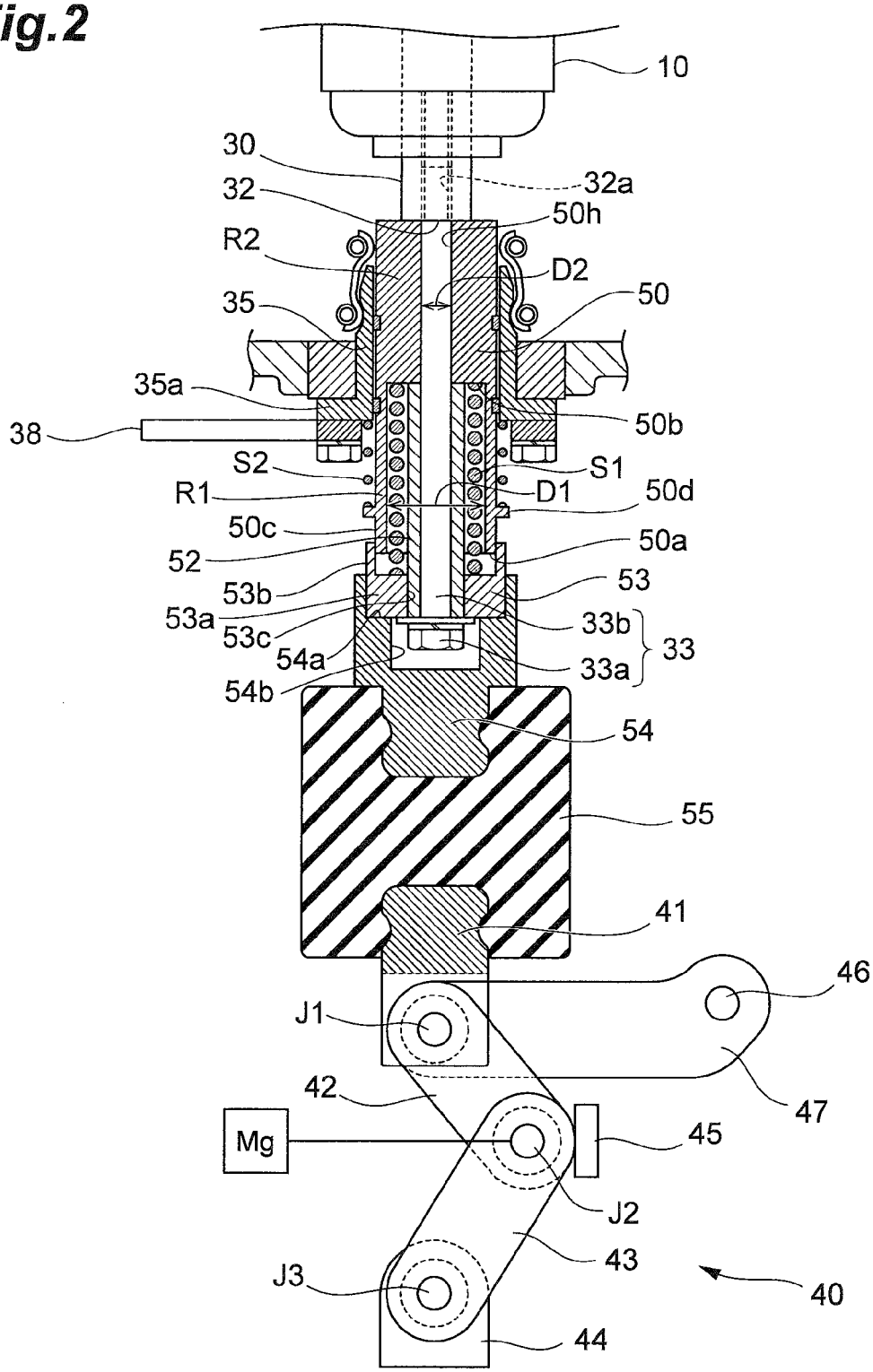
FIG. 2 is an enlarged sectional view illustrating a part of the switchgear shown in FIG. 1.

The spring-mounting member 50 is configured of a tubular member (for example, a cylindrical member) and has an opening 50*h* penetrated in the moving direction of the movable electrode 30. As shown in FIGS. 1 and 2, the spring-mounting member 50 houses the engaging spring S1 therein, and has the disengaging spring S2 at an outer periphery thereof. The two springs S1 and S2 which are coil springs are mounted to the spring-mounting member 50 such that centers of diametric directions of the two springs S1 and S2 are substantially coaxial. The spring-mounting member 50 constitutes a single whole. The spring-mounting member constituting "a single whole" mentioned here may be a spring-mounting member configured as a single member, or a spring-mounting member configured with a plurality of parts such that some parts do not move relative to the other parts while being mounted to the switchgear 100.

A shaft 33*b* of the bolt 33 passes through the opening 50*h* of the spring-mounting member 50. As shown in FIG. 2, the size of the opening of the spring-mounting member 50 is configured such that a size of a first section R1 from an end 50*a* to the middle portion thereof is larger than that of a second section R2 configured by the remaining parts. The engaging spring S1 is housed in the first section R1. In the first section R1, a collar 52 is disposed along an outer periphery of the shaft 33*b* of the bolt 33, and the engaging spring S1 is further disposed along an outer periphery of the collar 52. The inner surface of the first section R1 and the outer surface of the collar 52 suppress the engaging spring S1 from bending in a transverse direction when the engaging spring S1 is compressed. The size of the opening of the spring-mounting member 50 corresponds to the area of the opening 50*h*. As shown in FIG. 2, when the sectional shape of the opening corresponds to a circular shape, an inner diameter D1 of the first section R1 is larger than an inner diameter D2 of the second section R2.

A spring seat 53 is disposed between the end 50*a* of the spring-mounting member 50 and the head portion 33*a* of the bolt 33. A lower end of the engaging spring S1 is in contact with the spring seat 53. An upper end of the engaging spring S1 is in contact with a boundary surface 50*b* between the first section R1 and the second section R2 of the spring-mounting member 50. The above-mentioned collar 52 also serves to prescribe an initial length of the engaging spring S1 in cooperation with the spring seat 53 and the bolt 33 in addition to preventing the bending of the engaging spring S1. The collar 52 is disposed within the first section R1 of the spring-mounting member 50, the spring seat 53 is disposed at the end of the collar 52, and then an initial length of the engaging spring S1 may be set by tightening the bolt 33 through the shaft 33*b* of the bolt 33 at an opening of the collar 52 (See FIG. 2). A washer may be disposed between the head portion 33*a* of the bolt and the spring seat 53.

The spring seat 53 has a disc 53*a* contacting a lower end of the engaging spring S1 and a tubular portion 53*b* extending from a periphery of the disc 53*a* in the direction of the spring-mounting member 50. An opening 53*c* is formed at a center of the disc 53*a*, and the shaft 33*b* of the bolt 33 and the collar 52 pass through the opening 53*c*. As shown in FIG. 2, in a state (initial state) where the bolt 33 is tightened, the disc 53*a* of the spring seat 53 and the end surface 50*a* of the spring-mounting member 50 are spaced apart from each other. A distance between the disc 53*a* and the end surface 50*a* is set to be larger than the displacement of the engaging spring S1.

The tubular portion 53*b* of the spring seat 53 is disposed along an outer periphery of a lower portion 50*c* of the spring-mounting member 50 and configures a sliding portion with respect to the spring-mounting member 50. An inner surface of the opening 53*a* configures a sliding portion with respect to the collar 52. The spring seat 53 is slidable (movable) with respect to the spring-mounting member 50 and the collar 52. When the spring seat 53 is slidable with respect to the spring-mounting member 50 and the collar 52, bending at the corresponding portions can be restrained from being generated.

The spring-mounting member 50 has a flange 50*d* at an outer periphery thereof. The flange 50*d* is in contact with a lower end of the disengaging spring S2. An upper end of the disengaging spring S2 is in contact with a flange portion 35*a* of the collar 35. The flange 50*d* is formed at a location adjacent to a lower end of the spring-mounting member 50, which does not interfere with the sliding of the spring seat 53 according to compression of the engaging spring S1.

The spring-mounting member 50 is connected to an insulator 55 via a joining member 54 installed to cover the spring seat 53 and the head portion 33*a* of the bolt 33. The joining member 54 has a holding portion 54*a* for supporting the spring seat 53 and a recessed portion 54*b* for receiving the head portion 33*a* of the bolt 33. Since the head portion 33*a* protrudes from the spring seat 53 according to the compression of the engaging spring S1, the recessed portion 54*b* has a depth corresponding to the protruding amount (See FIG. 3C). The insulator 55 has a shape of, for example, a rectangular solid, and a connection member 41 constituting a part of the linkage assembly 40 is mounted to a surface opposite to a surface to which the connection member 54 is mounted.

The linkage assembly 40 is configured to drive the movable electrode 30, and switch connection between the fixed electrode 20 and the movable electrode 30, and disconnection of the movable electrode 30 from the fixed electrode 20. The linkage assembly 40 includes a plurality of arms and a plurality of joints for connecting the arms. In detail, the linkage assembly 40 is configured by a first joint J1 for rotatably connecting the connection member 41 and an end of an upper arm 42, a second joint J2 for rotatably connecting another end of the upper arm 42 and an end of a lower arm 43, a third joint J3 for rotatably connecting another end of the lower arm 43 and a stand 44, a stopper 45 for restraining a moving range of the second joint J2, a magnet Mg for driving (pulling or pushing) the second joint J2, and an assistant arm 47 for connecting the first joint J1 and a shaft 46 at a transverse side of the first joint J1 (See FIG. 2). The assistant arm 47 restrains transverse movement of the first joint J1.

In the embodiment, a resilient force of the engaging spring S1 is larger than a resilient force of the disengaging spring S2. That is, as a force is applied from the linkage assembly 40 to the spring-mounting member 50 in a direction in which the movable contact 31 approaches the fixed contact 21, first the disengaging spring S2 is compressed, and then, as the movable contact 31 comes into contact with the fixed contact 21, the engaging spring S1 is compressed.

Hereinafter, referring to FIGS. 3A to 3C and FIG. 4, an operation, in which the switchgear 100 is switched from a state where the fixed electrode 20 and the movable electrode 30 are separated from each other (a state where the electrodes are disconnected) to a state where the fixed electrode 20 and the movable electrode 30 are connected, will be described.

Figures 3A, 3B, 3C:
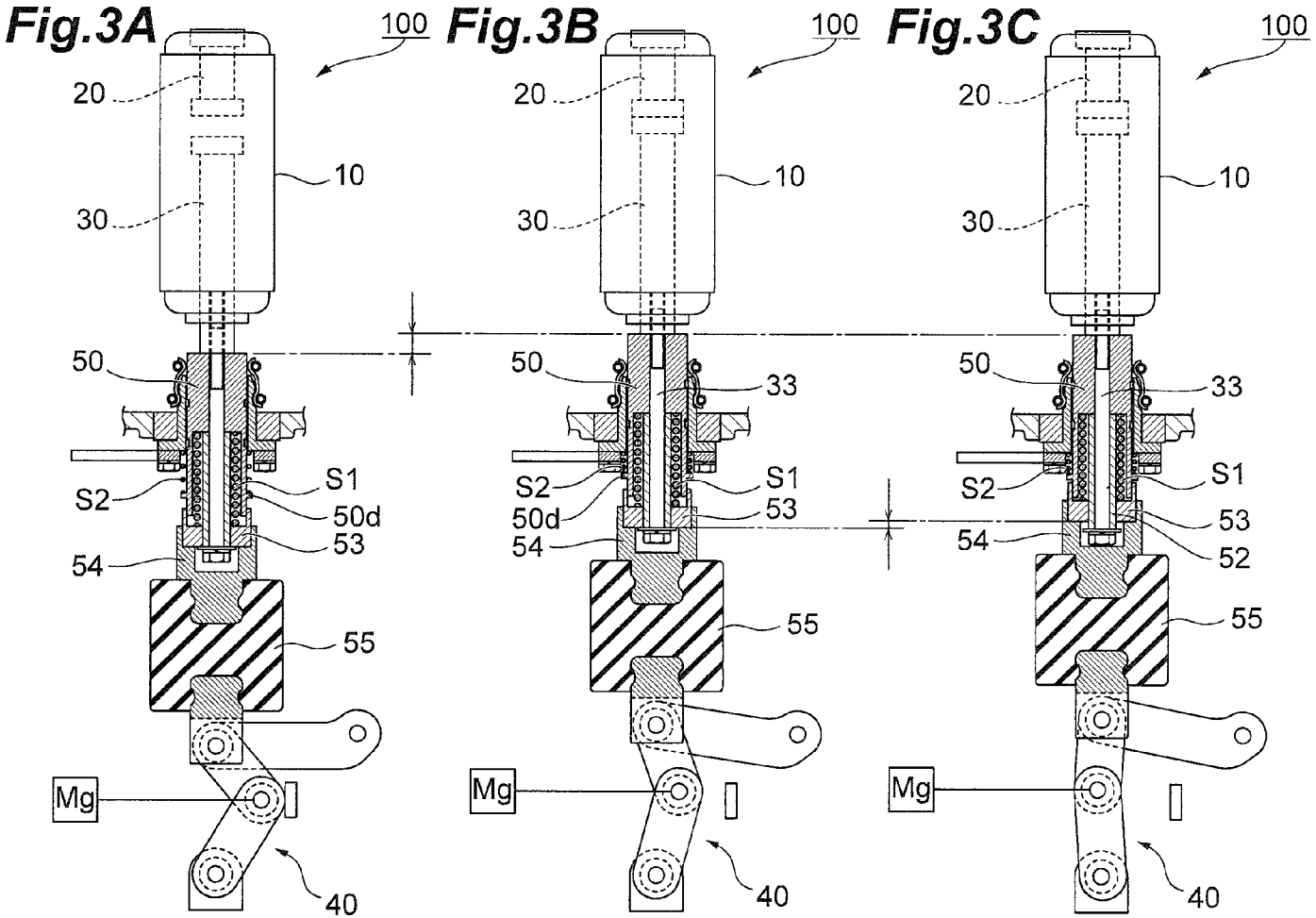
FIGS. 3A to 3C are sectional views illustrating an operation of the switchgear shown in FIG. 1.

FIG. 3A illustrates a state in which the two contacts 21, 31 are separated. FIG. 3B illustrates a state in which the two contacts 21, 31 are in contact with each other. FIG. 3C illustrates a state in which the movable contact 31 is engaged with the fixed contact 21. First, from a state shown in FIG. 3A, the magnet Mg attracts the second joint J2 so that the movable electrode 30 is pushed upward toward the fixed electrode 20. The movable contact 31 comes into contact with the fixed contact 21 shortly before an angle between the upper arm 42 and the lower arm 43 becomes 180° (See FIG. 3B). When the switchgear 100 changes from a state shown in FIG. 3A to a state shown in FIG. 3B, the engaging spring S1 pushes the spring-mounting member 50 upward while maintaining the initial length. Thereby the flange 50*d* moves upward, and as a result the disengaging spring S2 is compressed.

Next, from a state shown in FIG. 3B, the magnet Mg further attracts the second joint J2 so that the movable electrode 30 is pressed toward the fixed electrode 20. In the embodiment, when the angle between the upper arm 42 and the lower arm 43 becomes about 180°, that is, 170°~180° (a state where the joints J1, J2, and J3 are aligned in an approximately straight line), a force for pressing the movable electrode 30 with respect to the fixed electrode 20 is maximal (See FIG. 3C). When the switchgear 100 is switched from a state shown in FIG. 3B to a state shown in FIG. 3C, only the engaging spring S1 is compressed. That is, the connection member 54 pushes the spring seat 53 upward, so that the spring seat 53 compresses the engaging spring S1. At this time, the spring seat 53 slides with respect to the spring-mounting member 50 and the collar 52. The spring-mounting member 50 and the collar 52 are integrally fixed together with the movable electrode 30 by the bolt 33. In a state where the movable electrode 30 is in contact with the fixed electrode 20, that is, in a state where the movable electrode 30 does not move, the disengaging spring S2 is not further compressed, because in this state the spring-mounting member 50 does not move.

Figure 4:
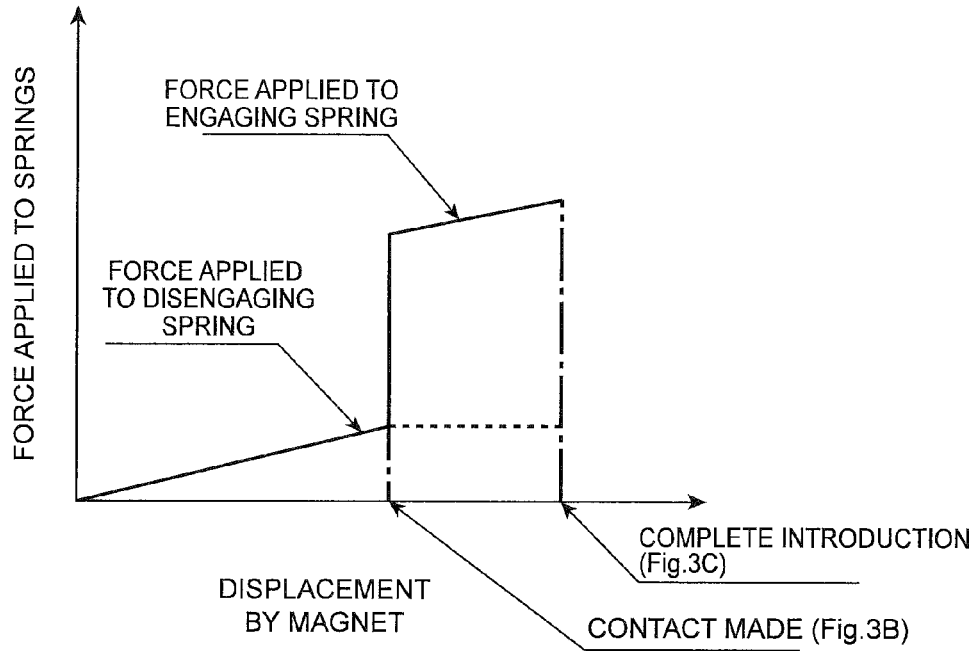
FIG. 4 is a graph depicting a relation between a displacement by a magnet and a force applied to springs.

Since the disengaging spring S2 is not further compressed after the two contacts 21 and 31 are in contact with each other even when the displacement by the magnet increases, a graph of the disengaging spring S2 maintains a horizontal state as shown by a dotted line of FIG. 4. When the force applied to the disengaging spring S2 increases even after the two contacts 21 and 31 are in contact with each other, the sum of the force applied to the disengaging spring S1 and the force applied to the engaging spring S1 may increase excessively. In this case, the strength of the entirety of the switchgear should increases so that it is difficult to manufacture the switchgear having a compact size.

In order to switch from the electrically connected state to the disconnected state, the switchgear is switched from the state shown in FIG. 3C, via the state shown in FIG. 3B, to the state shown in FIG. 3A. In the switchgear according to the related art which employs only one spring, the movable electrode may become reconnected to the fixed electrode due to bouncing of the movable electrode if the moving speed of the movable electrode is excessively high when the electrodes are opened. Accordingly, by this embodiment, bouncing may be restrained from being generated by employing both of the two coil springs S1 and S2. An interval between the two contacts 21 and 31 may be set to be sufficiently narrow as a result of restraining bouncing, thereby achieving an excellent disconnection performance (insulation performance). The interval between the two contacts 21 and 31 (when the electrodes are disconnected) may be set, for example, to be about 15 mm or less, and preferably, in a range of about 10 mm to about 12 mm.

The switchgear may be applied to, for example, a power distribution system for supplying electricity from a substation to a user. When a short-circuit is generated in the power distribution system, for example, a short-circuit current larger than 5000 A may flow through the switchgear. In this case, a repulsive force is generated between the two contacts by the current. When a force allowing one contact to press the other contact is insufficient, the contacting state between the two contacts may be released by the repulsive force at an unintended time point. According to investigation of the present inventor, it is difficult that the switchgear according to the related art sufficiently increases the pressing force between the contacts while maintaining a compact size. This is because the rigidity of the switchgear needs to increase by increasing the whole size of the switchgear since bending is generated at members (for example, electrodes and rods) of the switchgear by the large pressing force.

In contrast, the switchgear 100 sufficiently increases a force for pressing the movable electrode 30 with respect to the fixed electrode 20 while maintaining a compact size. Thus, even when a short-circuit is generated at the power distribution system, the contacting state between the two contacts 21 and 31 is sufficiently restrained from being released at an unintended time point. A short-circuit current which can be generated is not limited to a value exceeding 5000 A.

In the above embodiment, although it is exemplified that the insulator 55 is disposed between the spring-mounting member 50 and the linkage assembly 40, the insulator 55 may not be employed, for example, when a part of components of the linkage assembly 40 is configured of an insulating material. Further, the joining member 54 may be configured of an insulating material, and the joining member 54 and the insulator 55 may be integrally formed. Further, the movable electrode 30 may be driven by an assembly different from the linkage assembly 40.

Indeed, the novel devices and methods described herein may be embodied in a variety of other forms; furthermore, various omissions, substitutions and changes in the form of the devices and methods described herein may be made without departing from the spirit of the inventions. The accompanying claims and their equivalents are intended to cover such forms or modification as would fall within the scope and spirit of the inventions.

What is claimed is:

1. A switchgear comprising:

a vacuum chamber capable of maintaining an inside thereof in a decompressed state;

a fixed electrode having a fixed contact at an end thereof, the fixed contact being disposed within the vacuum chamber;

a movable electrode having a movable contact at an end thereof, the movable contact being disposed within the vacuum chamber and at a position facing the fixed contact;

a linkage assembly configured to electrically connect or disconnect the movable electrode and the fixed electrode;

an engaging coil spring configured to transfer a force to the movable electrode in a direction in which the movable contact engages with the fixed contact;

a disengaging coil spring configured to transfer a force to the movable electrode in a direction in which the movable contact disengages from the fixed contact;

a spring-mounting member configured as a tubular member, having an opening passing through the member in a moving direction of the movable electrode, installed between the movable electrode and the linkage assembly, and provided with the engaging coil spring and the disengaging coil spring;

a flange formed at an outer periphery of the spring-mounting member, and being in contact with an end of the disengaging coil spring;

a spring seat being in contact with an end of the engaging coil spring, and having an opening; and a bolt fixing the movable electrode and the spring-mounting member together and having a shaft, the shaft passing through insides of the openings of the spring-mounting member and the spring seat, wherein the engaging coil spring is housed within the spring-mounting member, and the disengaging coil spring is disposed along an outer periphery of the spring-mounting member such that centers of the diametric directions of the engaging coil spring and the disengaging coil spring are substantially coaxial and at least a part of the engaging coil spring and a part of the disengaging coil spring overlap each other in the moving direction of the movable electrode, and wherein the spring seat is movable with respect to the spring-mounting member and the shaft of the bolt.

2. The switchgear according to claim 1, wherein a resilient force of the engaging coil spring is larger than a resilient force of the disengaging coil spring.

3. The switchgear according to claim 1, wherein, as a force is applied from the linkage assembly to the spring-mounting member in a direction in which the movable contact approaches the fixed contact, first the disengaging coil spring is compressed, and then, as the movable contact comes into contact with the fixed contact, the engaging coil spring is compressed.

4. The switchgear according to claim 1, wherein, as a force is applied from the linkage assembly to the spring-mounting member in a direction in which the movable contact approaches the fixed contact, first the disengaging coil spring is compressed while the engaging coil spring is substantially maintained at an initial length, and then as the movable contact comes into contact with the fixed contact, the disengaging coil spring is substantially not further compressed while the engaging coil spring is compressed.

5. The switchgear according to claim 1, wherein an area of the opening of the spring-mounting member is configured such that an area of a first section from an end of the spring-mounting member to a middle portion thereof is larger than an area of a second section configured by remaining parts, and the engaging coil spring is housed in the first section.

6. The switchgear according to claim 1, wherein the spring seat has a sliding portion with respect to the spring-mounting member.

7. The switchgear according to claim 1, further comprising a collar housed in the spring-mounting member at an outside of the bolt and inside of the engaging coil spring, and fixed to the spring-mounting member by the bolt.

8. The switchgear according to claim 1, further comprising an insulator disposed between the movable electrode and the linkage assembly.

9. The switchgear according to claim 1, wherein the linkage assembly comprises a joining member movable in the moving direction of the movable electrode; a first arm; a second arm; a stand; a first joint configured to rotatably connect the joining member and a one end of the first arm; a second joint configured to rotatably connect an other end of the first arm and a one end of the second arm; and a third joint configured to rotatably connect an other end of the second arm and the stand, wherein the linkage assembly is configured such that a force for pressing the movable electrode toward the fixed electrode is maximized when the first joint, the second joint, and the third joint are aligned in an approximately straight line.

10. A switchgear comprising:

a vacuum chamber capable of maintaining an inside thereof in a decompressed state;

a fixed electrode having a fixed contact at an end thereof, the fixed contact being disposed within the vacuum chamber;

a movable electrode having a movable contact at an end thereof, the movable contact being disposed within the vacuum chamber and at a position facing the fixed contact;

a linkage assembly configured to electrically connect or disconnect the movable electrode and the fixed electrode;

an engaging coil spring configured to transfer a force to the movable electrode in a direction in which the movable contact engages with the fixed contact;

a disengaging coil spring configured to transfer a force to the movable electrode in a direction in which the movable contact disengages from the fixed contact;

a spring-mounting member configured as a tubular member, having an opening passing through the member in a moving direction of the movable electrode, installed between the movable electrode and the linkage assembly, and provided with the engaging coil spring and the disengaging coil spring, a flange formed at an outer periphery of the spring-mounting member, and being in contact with an end of the disengaging coil spring, a spring seat being in contact with an end of the engaging coil spring, having an opening, and sliding with respect to the spring-mounting member, and a bolt fixing the movable electrode and the spring-mounting member together and having a shaft, the shaft passing through insides of the openings of the spring-mounting member and the spring seat, wherein a resilient force of the engaging coil spring is larger than a resilient force of the disengaging coil spring, wherein the engaging coil spring is housed in the spring-mounting member, and the disengaging coil spring is disposed along an outer periphery of the spring-mounting member such that at least a part of the engaging coil spring and a part of the disengaging coil spring overlap each other in the moving direction of the movable electrode, and wherein the spring seat is movable with respect to the spring-mounting member and the shaft of the bolt.

11. A switchgear comprising:

a vacuum chamber capable of maintaining an inside thereof in a decompressed state;

a fixed electrode having a fixed contact at an end thereof, the fixed contact being disposed within the vacuum chamber;

a movable electrode having a movable contact at an end thereof, the movable contact being disposed within the vacuum chamber and at a position facing the fixed contact;

a linkage assembly configured to electrically connect or disconnect the movable electrode and the fixed electrode;

an engaging coil spring configured to transfer a force to the movable electrode in a direction in which the movable contact engages with the fixed contact;

a disengaging coil spring configured to transfer a force to the movable electrode in a direction in which the movable contact disengages from the fixed contact; and a spring-mounting member constituting a single whole, having an opening passing through the member in a moving direction of the movable electrode, installed between the movable electrode and the linkage assembly, and provided with the engaging coil spring and the disengaging coil spring, wherein the engaging coil spring and the disengaging coil spring are provided such that centers of the diametric directions of the engaging coil spring and the disengaging coil spring are substantially coaxial and at least a part of the engaging coil spring and a part of the disengaging coil spring overlap each other in the moving direction of the movable electrode; and wherein, as a force is applied from the linkage assembly to the spring-mounting member in a direction in which the movable contact approaches the fixed contact, first the disengaging coil spring is compressed while the engaging coil spring is substantially maintained at an initial length, and then as the movable contact comes into contact with the fixed contact, the disengaging coil spring is substantially not further compressed while the engaging coil spring is compressed.

* * * * *